US008371913B1

(12) United States Patent
Taylor

(10) Patent No.: US 8,371,913 B1
(45) Date of Patent: Feb. 12, 2013

(54) EXTERIOR SEALED WINDOW-MOUNTED FAN

(76) Inventor: Sandy Taylor, Douglasville, GA (US)

( * ) Notice: Subject to any disclaimer, the term of this patent is extended or adjusted under 35 U.S.C. 154(b) by 951 days.

(21) Appl. No.: 12/171,460

(22) Filed: Jul. 11, 2008

Related U.S. Application Data

(63) Continuation-in-part of application No. 11/903,321, filed on Sep. 21, 2007.

(51) Int. Cl.
*F24F 7/013* (2006.01)

(52) U.S. Cl. ..... 454/210

(58) Field of Classification Search ..... 454/210, 454/201, 202, 203, 204, 205, 206, 207, 208, 454/209
See application file for complete search history.

(56) References Cited

U.S. PATENT DOCUMENTS 1,780,903 A * 11/1930 Berman ..... 454/151
2,549,042 A * 4/1951 Angermueller ..... 454/57
2,811,022 A * 10/1957 Lathrop ..... 62/427
4,676,145 A * 6/1987 Allred ..... 454/276
4,773,310 A * 9/1988 Corwin ..... 454/244
4,905,511 A * 3/1990 Reinhold ..... 73/168
5,334,091 A * 8/1994 Shih-Chin ..... 454/210
6,045,444 A * 4/2000 Zima et al. ..... 454/121
7,232,369 B2 * 6/2007 Karidis et al. ..... 454/274
2006/0046632 A1 * 3/2006 Goupil et al. ..... 454/121

* cited by examiner

*Primary Examiner* — Steven B McAllister
*Assistant Examiner* — Samantha Miller

(57) ABSTRACT

The present invention relates to an exterior sealed window-mounted fan. The fan is designed to be able to fully seal the intake and exhaust air chambers when the system is not in use. The present invention includes a dual panel frame that can completely seal the exterior portion of the opening from the interior portion. The invention can be left in a window all year long if so desired, and the invention can be sealed close during bad weather or opened during desired weather. Along the top surface of the invention is a grooved notch for stabilizing the unit in place with respect to the window and window frame. The invention includes a plurality of electrical fans. The invention includes a pair of adjustable louvers in for the invention to be used with a plurality of window openings. A system of exterior sliding vents seal the exterior of the dwelling from the interior, and is manually operated by a vent control.

1 Claim, 9 Drawing Sheets

EXTERIOR SEALED WINDOW-MOUNTED FAN

CROSS REFERENCES TO RELATED APPLICATIONS

This is a continuation-in-part to the non-provisional application Ser. No. 11/903,321 filed on Sep. 21, 2007.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to an exterior sealed window-mounted fan. The fan is designed to be able to fully seal the intake and exhaust air chambers when the system is not in use.

A conventional fan by design has its rear panel subjected to the exterior weather elements such as dust, dirt, mold, and other particles. Theses exterior elements can enter the interior of the home through the rear paneling and this problem becomes especially apparent after a period of nonuse.

The present invention seeks to remedy this problem by providing a dual panel frame system that can completely seal the exterior portion of the system from the interior portion. To further eliminate any particles from entering, the present invention can also have a filter type apparatus inserted adjacent to the dual panel frame type system.

B. Discussion of the Prior Art

As a preliminary note, it should be stated that there is an ample amount of prior art that deals with window-mounted fans. As will be discussed immediately below, no prior art discloses a window-mounted fan that includes a mechanism that closes the fan shafts when the device is not in use.

The Shih-Chin Patent (U.S. Pat. No. 5,190,496) discloses a window fan that locks into place for the purpose of creating a secure mounting system to a window. The Shih-Chin Patent uses side extensions on the outer edges of the window fan to allow the fan utility to be mounted and secured to multiple width openings. However, the Shih-Chin Patent does not enclose or seal the exterior openings of the fan shafts. The purpose of the present invention is to close the openings of the exterior fan shafts during nonuse, thereby, minimizing debris and contamination.

The Milana Patent Application (U.S. Patent App. No. US2004/0081553) discloses an efficient axial fan that has a shutter assembly. The Milana design uses shutter vanes designed to open at roughly 250 RPMS, and when the fan is not running the shutters close. However, the Milana Patent differs because it employs a system for shutting exhaust fan openings that uses an internal compression spring to secure the flaps sealing the opening. Lastly, the Milana Patent does not circulate exterior air into the dwelling.

The Jane Patent et al (U.S. Pat. No. 5,743,709) discloses a sealable window fan with a manually adjustable closure. The Jane Patent's design allows for a closed chamber, however, this chamber only encloses the opening that the window fan is mounted on. The Jane Patent does not provide for the sealing or closing of the exterior fan shafts opening.

The Chan et al. Patent (U.S. Pat. No. 5,660,605) discloses a sealable window fan consisting of a filter with a manually adjustable deflector directing the discharged air as desired. The Chan Patent has an exterior adjustable deflector that controls the air being discharged from the exterior fan shafts; however, this devise does not seal the exterior fan shafts during nonuse.

The Wang et al. Patent (U.S. Pat. No. 5,664,996) discloses a window mounted fan having an adjustable grill to adjust the aid flow. The Wang Patent's adjustable grill controls the airflow from the window-mounted fan. However, the Wang Patent differs because it does not provide for the sealing or closing of the exterior fan shafts opening.

The Shih-Chin Patent (U.S. Pat. No. 5,334,091) discloses a window fan which locks into place for the purpose of creating a secure mounting system to a window or window screen. The Shih-Chin Patent uses side extensions on the outer edges of the window fan to allow the fan utility to be mounted and secured to multiple width openings. However, the Shih-Chin Patent does not enclose or seal the exterior openings of the fan shafts. The purpose of the present invention is to close the openings of the exterior fan shafts during nonuse, thereby, minimizing debris and contamination from entering the dwelling during non-use.

While the above-described devices fulfill their respective and particular objects and requirements, they do not describe a exterior sealed window-mounted fan that provides for the advantages of the exterior sealed window-mounted fan. In this regard, the exterior sealed window-mounted fan departs from the conventional concepts and designs of the prior art.

SUMMARY OF THE INVENTION

The present invention relates to an exterior sealed window-mounted fan. The fan is designed to be able to fully seal the intake and exhaust air chambers when the system is not in use. The present invention includes a dual panel frame that can completely seal the exterior portion of the opening from the interior portion. The invention can be left in a window all year long if so desired, and the invention can be sealed close during bad weather or opened during desired weather. Along the top surface of the invention is a grooved notch for stabilizing the unit in place with respect to the window and window frame. The invention includes a plurality of electrical fans. The invention includes a pair of adjustable louvers in for the invention to be used with a plurality of window openings. A system of exterior sliding vents seal the exterior of the dwelling from the interior, and is manually operated by a vent control.

An object of the invention is to provide a fan that mounts along an opening of a window, wherein the fan can be opened and closed so as to seal off the open window when the device is not in use.

These together with additional objects, features and advantages of the exterior sealed window-mounted fan will be readily apparent to those of ordinary skill in the art upon reading the following detailed description of presently preferred, but nonetheless illustrative, embodiments of the exterior sealed window-mounted fan when taken in conjunction with the accompanying drawings.

In this respect, before explaining the current embodiments of the exterior sealed window-mounted fan in detail, it is to be understood that the exterior sealed window-mounted fan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exterior sealed window-mounted fan. It is therefore important that the claims be regarded as including such equivalent construction insofar as they do not depart from the spirit and scope of the exterior sealed window-mounted fan. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
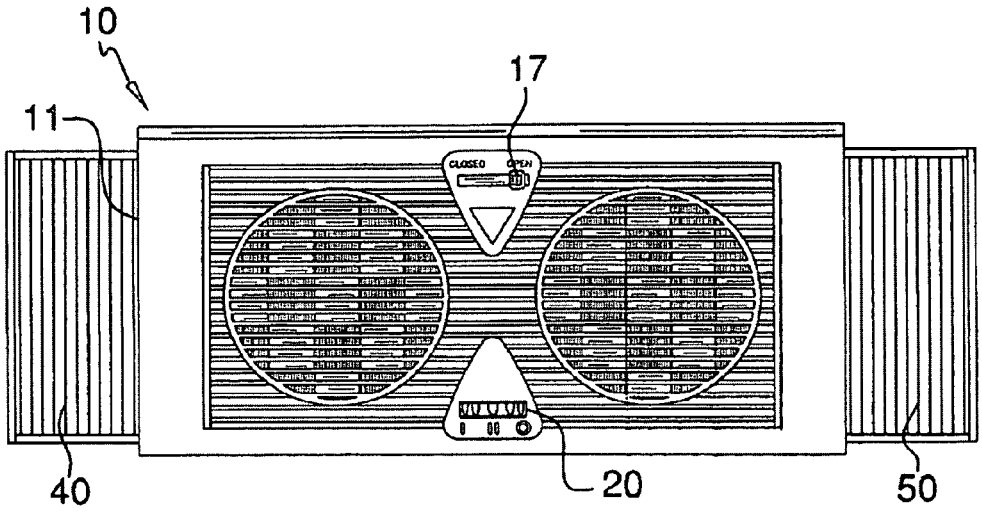
FIG. 1 illustrates a front view of invention.
Figure 2:
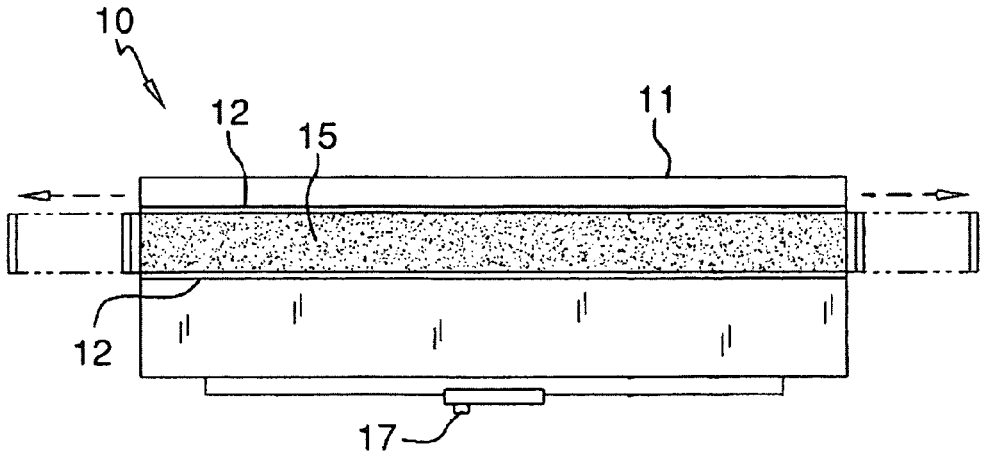
FIG. 2 illustrates a top view of the invention.
Figure 3:
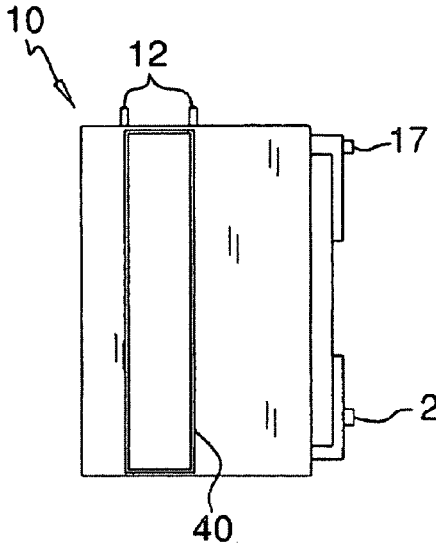
FIG. 3 illustrates a side view of the invention.
Figure 4:
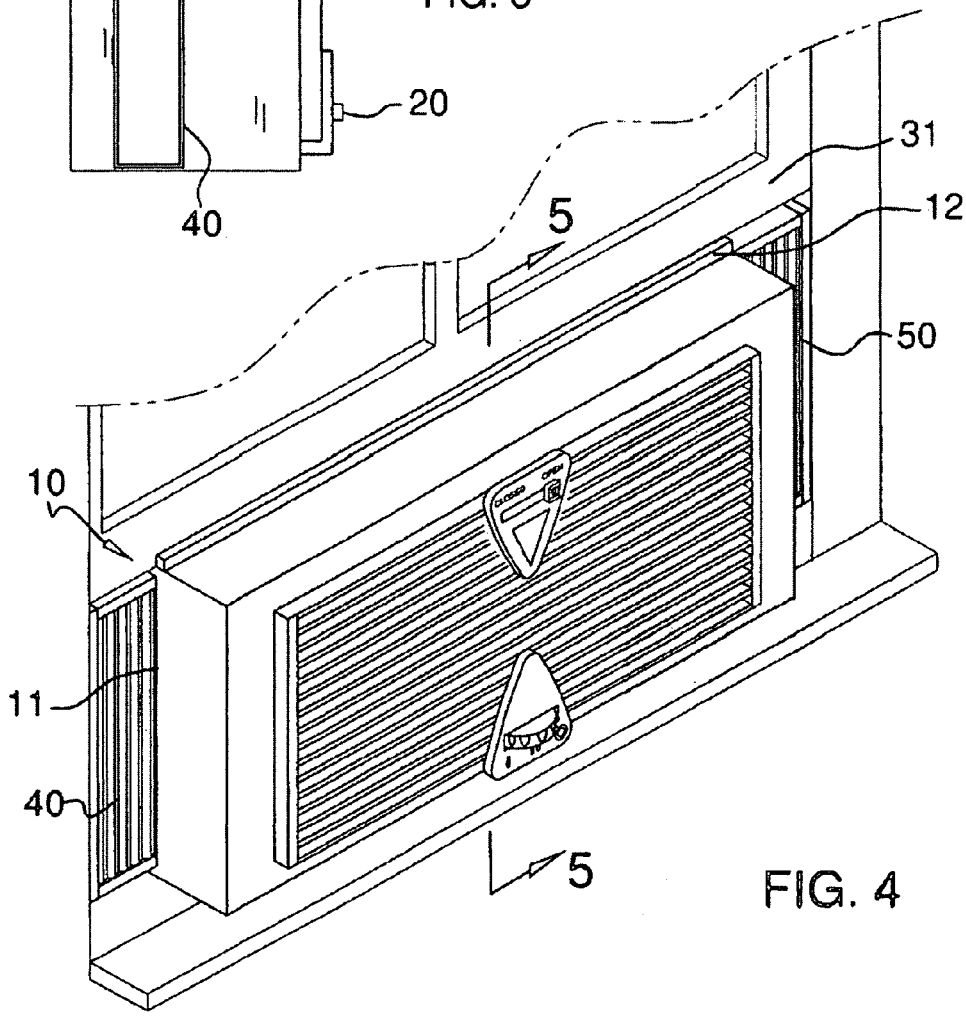
FIG. 4 illustrates an isometric view of the invention in use.
Figure 5:
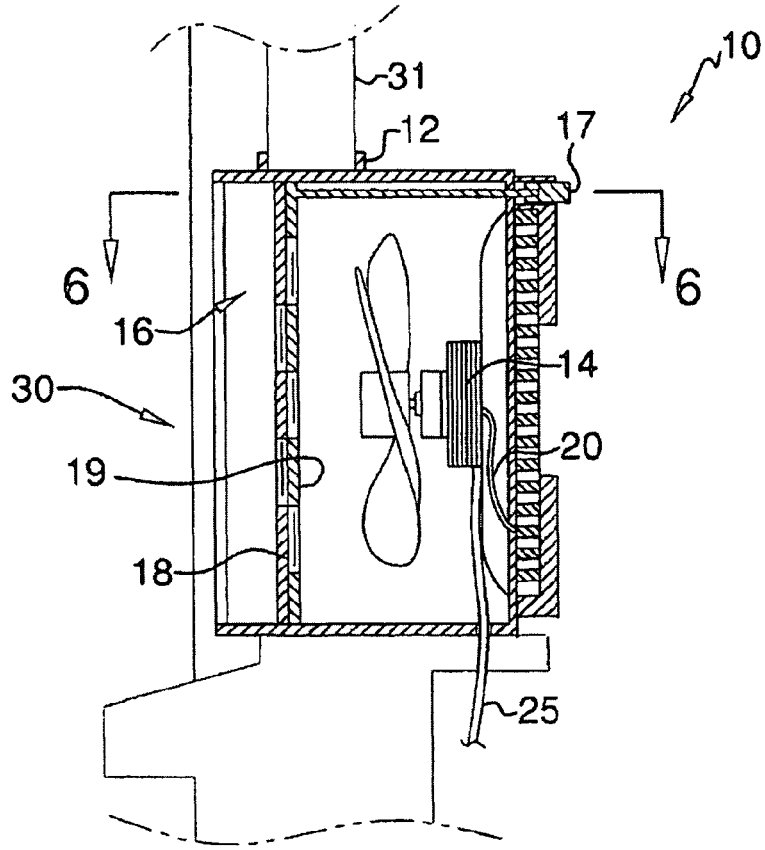
FIG. 5 illustrates a cross-sectional view of the invention along the lines of 5-5 in FIG. 4.
Figure 6:
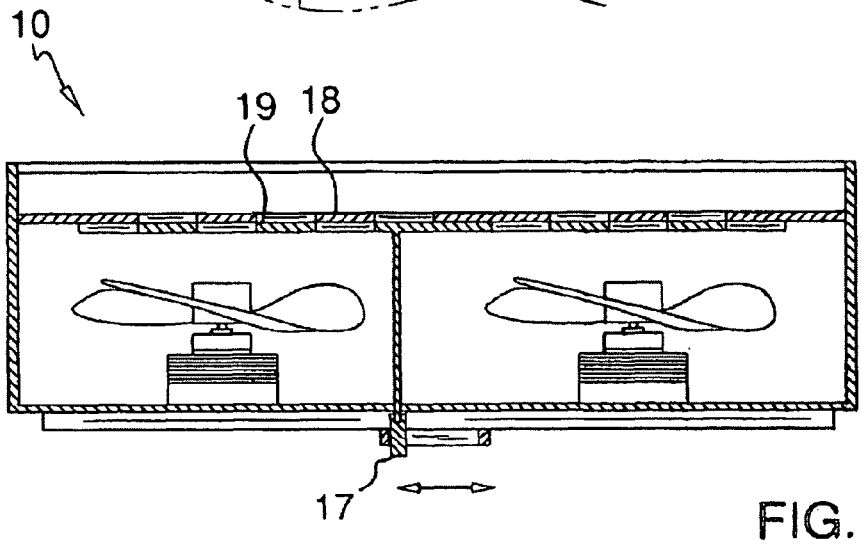
FIG. 6 illustrates a cross-sectional view of the invention along the lines of 6-6 in FIG. 5.
Figure 7:
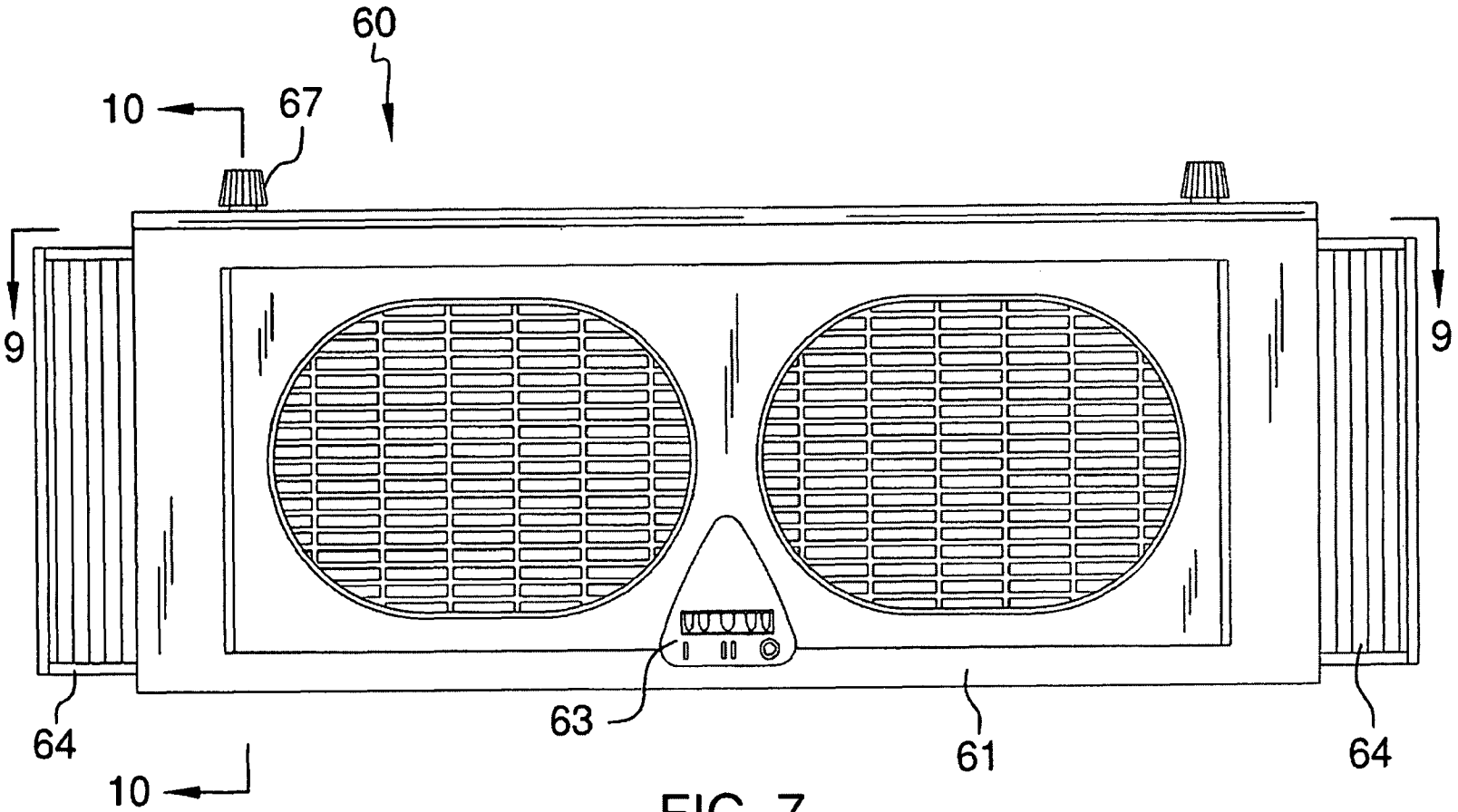
FIG. 7 illustrates a front view of an alternative embodiment.

Detailed reference will now be made to the present invention, examples of which are illustrated in FIGS. 1-6. An exterior-sealed window mounted fan 10 (hereinafter invention) includes a housing 11 having a pair of window notches 12 along the top exterior of the housing 11. The window notches 12 stabilize the invention 10 to a window opening 30 by situating the housing 11 to the underside of a window 31. Located along the top of the housing 11 and between the window notches 12 is a foam padding 15 that is designed to further seal the housing 11 to the underside of the window 31.

The invention 10 includes a plurality of electrical fans 14 that are mounted to the interior of the housing 11. Located within the housing 11 and between the electrical fans 14 and the side of the housing facing the exterior of the dwelling when the invention 10 is in use is a vent screen system 16. The vent screen system 16 is manually operated by a vent control tab 17 that is located along the side of the housing facing the interior of the dwelling.

The vent screen system 16 consists of a permanently positioned screen 18, and a sliding screen 19. The permanently positioned screen 18 has a plurality of checkered pattern openings. The sliding screen 19 has a plurality of checkered pattern openings that mirrors the checkered pattern openings of the permanently positioned screen 18.

The vent control tab 17 is secured to the sliding screen 19 and essentially aligns or misaligns the checkered pattern openings of the permanently positioned screen 18 with respect to the sliding screen 19. The end user can seal the exterior by simply sliding the vent control tab 17 to the marked position "closed," and vice versa for the "open" position.

It shall be noted that the permanently positioned screen 18 and the sliding screen 19 are designed so as to enable an end user the ability to remove said items from the invention 10 in order to be cleaned.

A fan control 20 is located on the side surface of the housing 11 that faces the interior of the dwelling. The plurality of electrical fans 14 have an electrical line 25 with a plug that simply plugs into a standard wall outlet. The electrical fans are controlled by the fan control tab 20.

The invention 10 includes a left expandable louver 40, and a right expandable louver 50. The left and right expandable louver 40 and 50 enables the invention 10 to be placed in a plurality of window openings. The outer ends of the left and right expandable louvers 40 and 50 have an adhesive strip (not shown) that enables the expandable louvers 40 and 50 to stay in a particular position once the invention 10 is installed.

The left and right expandable louver 40 and 50 are made of a durable plastic or metal.

The housing 11, the window notches 12, the vent control tab 17, and the checkered pattern closings of both the permanently positioned screen 18 and the sliding screen 19 are all made of a material comprising a durable plastic, wood, or metal.

Next, referring to FIGS. 7-12, an alternative embodiment 60 includes a housing 61, a plurality of fans 62, a fan control tab 63, a plurality of expandable louvers 64, a plurality of sliding slats 65, sprockets 66, slat control knobs 67, window notches 68, and a removable filter 69.

The basic premise of the alternative embodiment 60 is identical with the main embodiment of the invention 10. The only exception is that the vent screen system 16 of the invention 10 is replaced with the sliding slats 65, sprockets 66, and slat controls 67. The sliding slats 65 slide along a track 65' integrated into the housing 61. The sliding slats 65 slide via the rotation of the respective sprocket 66, which is rotated by the slat control knobs 67, as depicted in FIG. 8.

The sliding slats 65 create a seal between the opening in the housing 61 and the interior of the dwelling.

Figure 8:
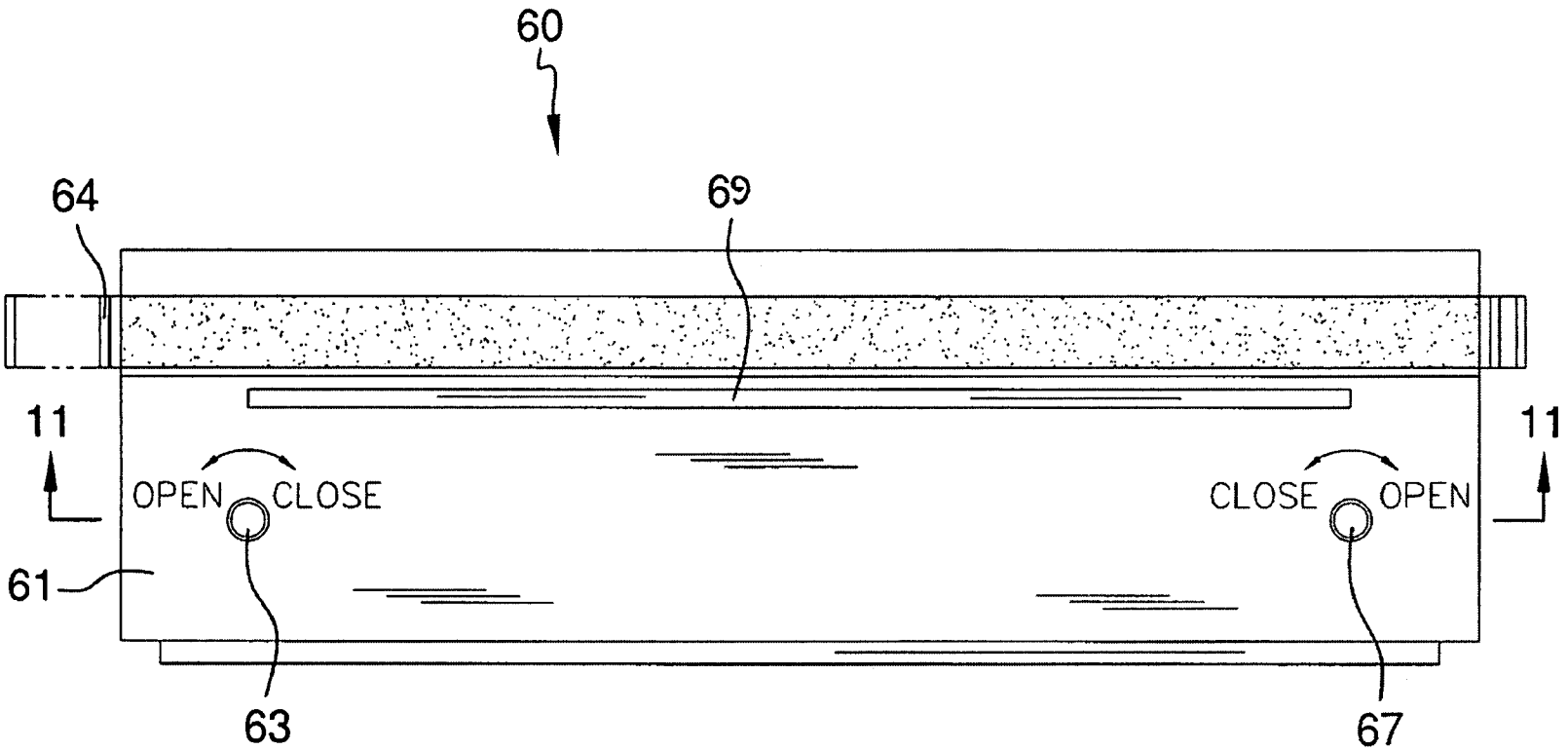
FIG. 8 illustrates a top view of the alternative embodiment.
Figure 9:
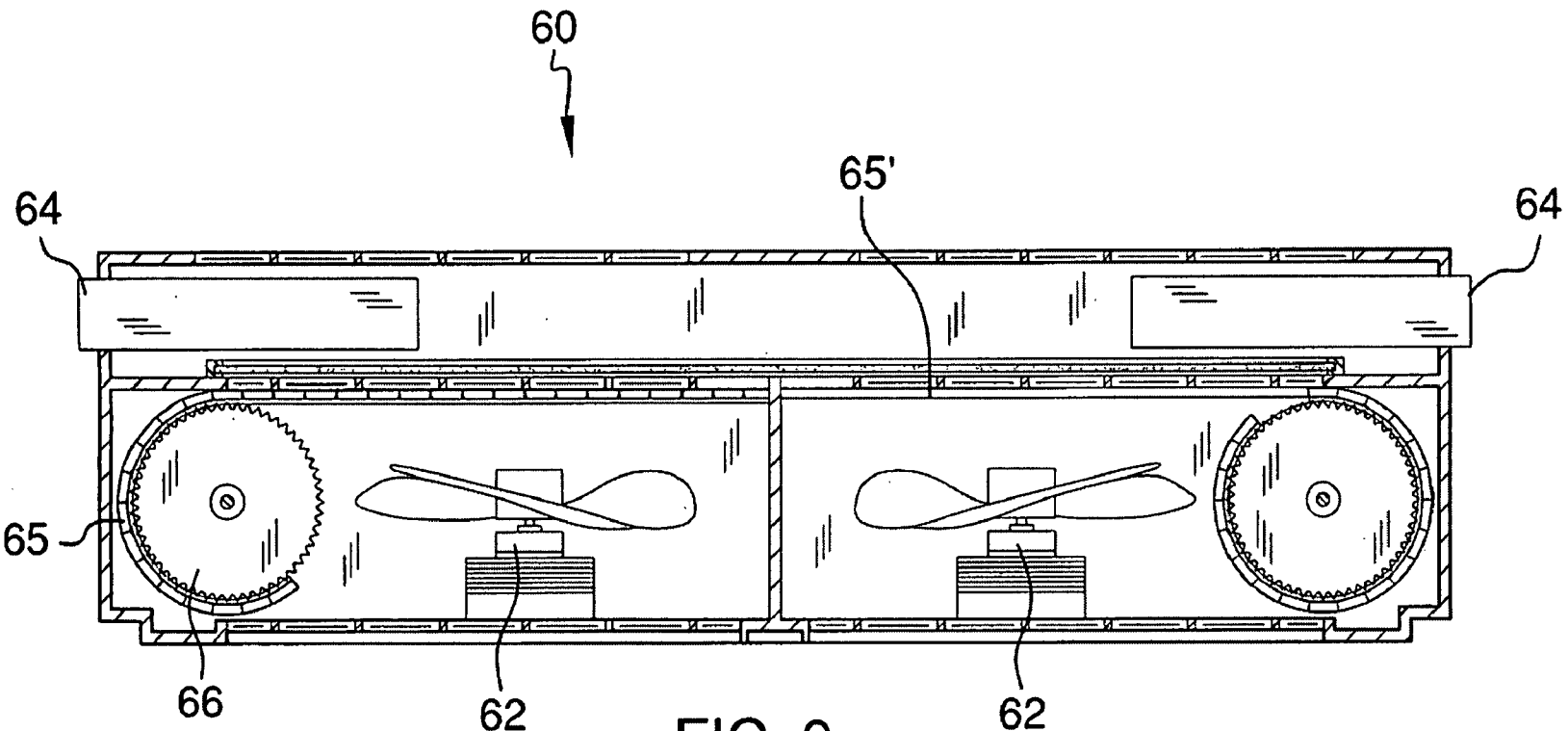
FIG. 9 illustrates a cross-sectional view of the interior of the alternative embodiment along line 9-9 in FIG. 7.
Figure 10:
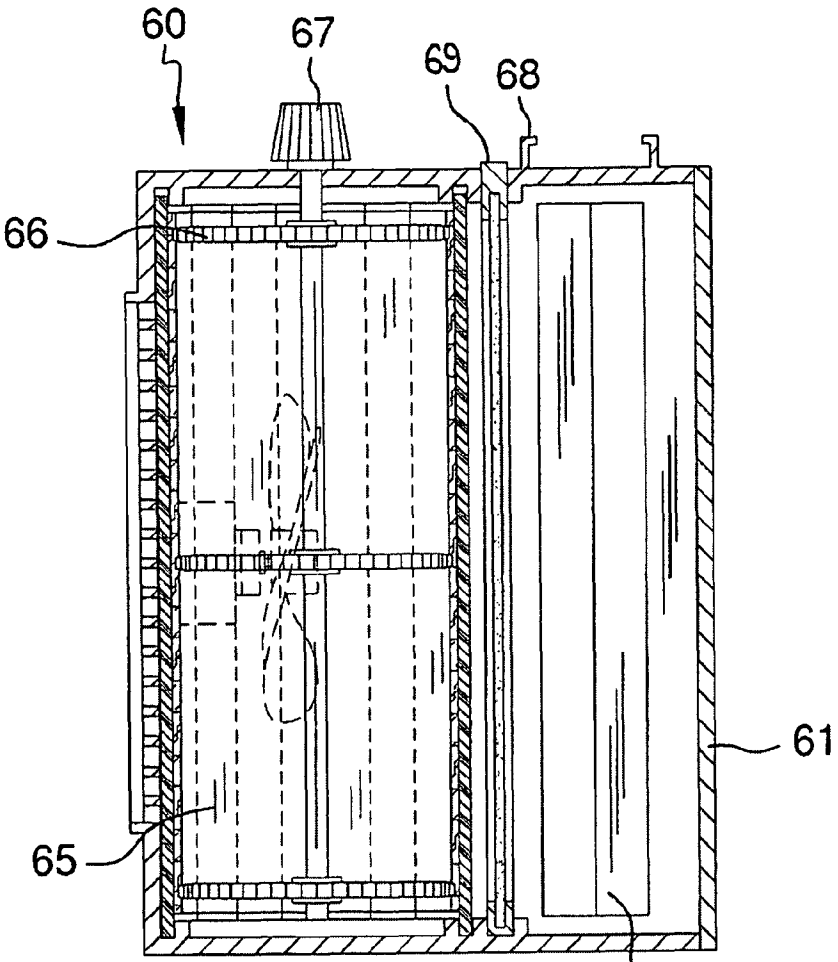
FIG. 10 illustrates another cross-sectional view of the 7; interior of the alternative embodiment along line 10-10 in FIG.
Figure 11:
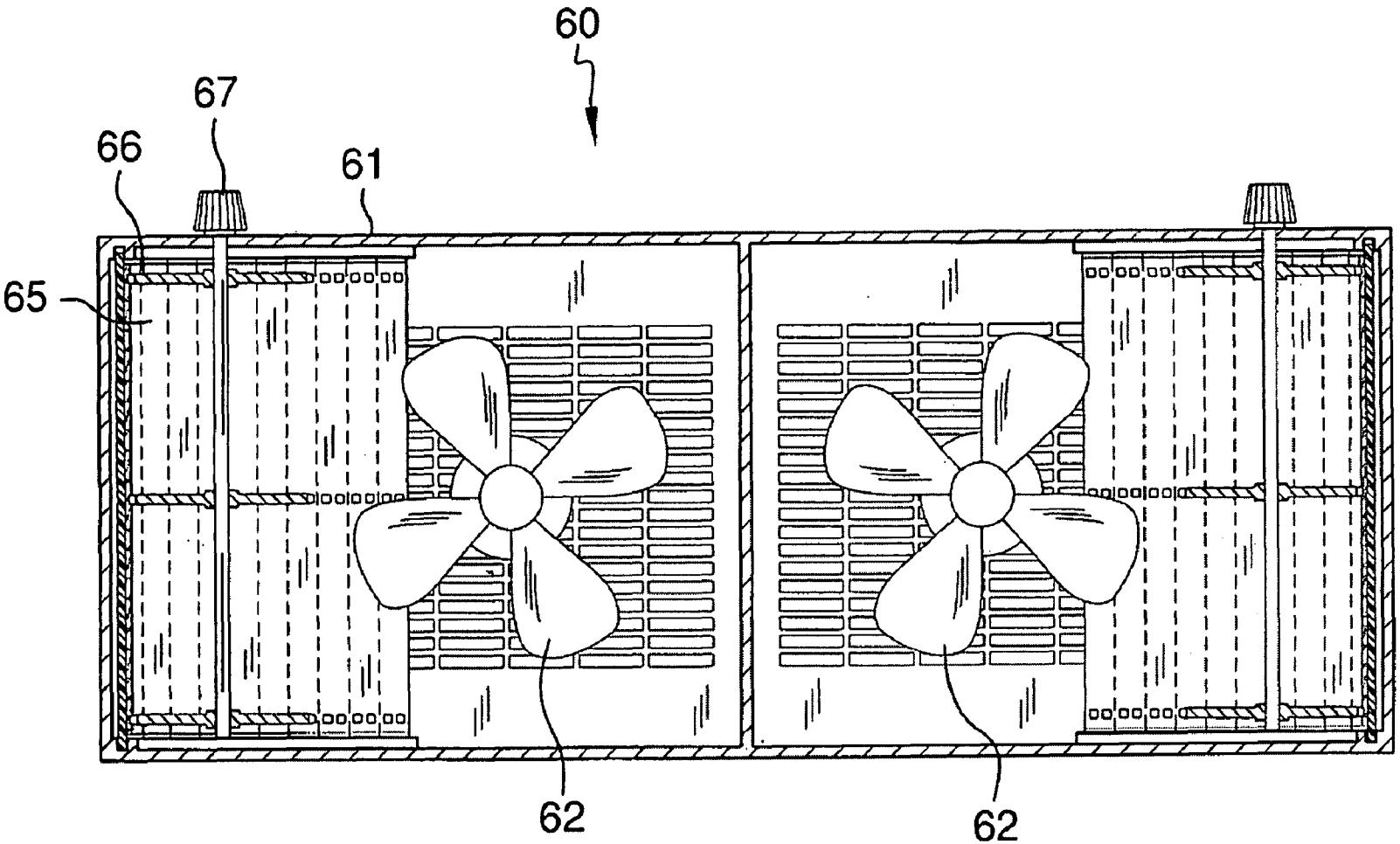
FIG. 11 illustrates a third cross-sectional view of the interior of the alternative embodiment along line 11-11 in FIG. 8.
Figure 12:
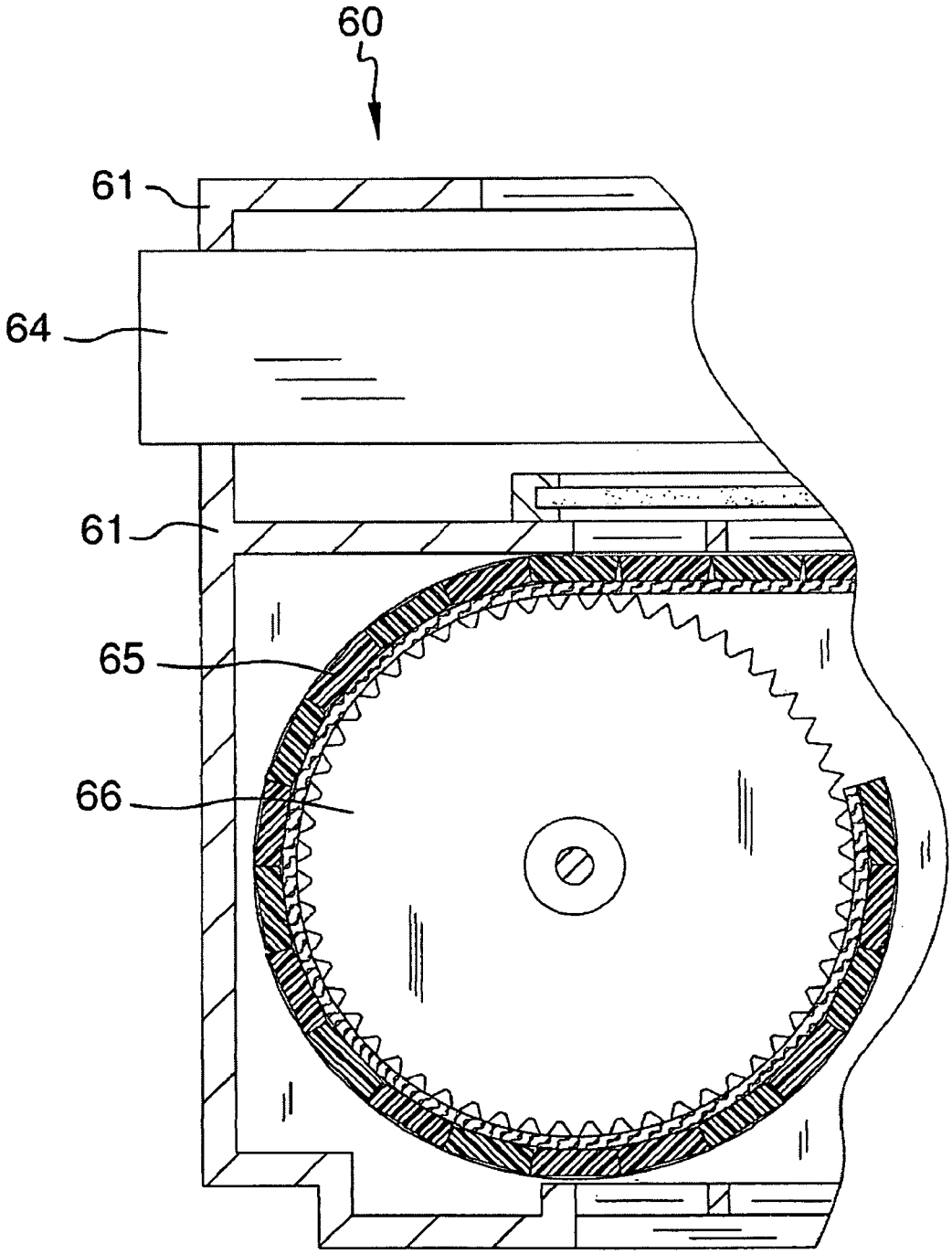
FIG. 12 illustrates a detailed view of the sprocket and slat from FIG. 9.

Referring to FIGS. 8 and 10, the removable filter 69 is located between the fans 62 and the side of the alternative embodiment 60 adjacent the interior of the dwelling. The removable filter 69 is removed by lifting upwards from the housing 61. However, it shall be noted that the removable filter 69 may be removed from a different side of the housing 61.

With respect to the above description, it is to be realized that the optimum dimensional relationship for the various components of the invention 10 and alternative embodiment 60, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and alternative embodiment 60.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exterior sealed window-mounted fan comprising:

a housing has a pair of window flanges that secure and/or stabilize the housing to a window by lowering a window onto the housing;

wherein a layer of foam padding is located on a top surface of the housing between the two window notches in order to provide a weather seal between the housing and window opening;

a plurality of electrical fans are located within the housing;

wherein a fan control is wiredly connected to the electrical fans;

a vent screen system can open and close to unseal or seal off the opening occupied by the housing;

a plurality of sliding slats slide along a track located within the housing;

wherein the track and the sliding slats are positioned between the opening in the housing adjacent the exterior of the dwelling and the electrical fans;

a plurality of sprockets rotate the sliding slats move laterally along their respective track;

a plurality of slat control knobs individually rotate one of the sprockets, which laterally moves the respective sliding slat to either coil around the sprocket and expose the opening within the housing or uncoil the sliding slat, which extends along the track to close off the opening within the housing;

wherein each slat control knob is responsible for manipulating a respective sprocket and sliding slat to open or close off a respective portion of the opening within the housing;

a plurality of expandable louvers are fitted along a side of the housing;

wherein the outermost edge of the expandable louvers are fitted with an adhesive strip for securing the housing with the respective side of the window opening;

wherein the housing consists of a rectangular shape that is designed to accommodate a standard width of a window opening;

wherein the fan control is a voltmeter that restricts the flow of electricity to the electrical fans;

wherein a removable filter is located between the fans and a side of the housing adjacent to the interior of a dwelling when installed.

* * * * *